US008707968B2

(12) United States Patent
Gardner

(10) Patent No.: US 8,707,968 B2
(45) Date of Patent: Apr. 29, 2014

(54) COMBINATION WEAVE REMOVAL TOOL APPARATUS AND METHOD FOR USE

(76) Inventor: Carla Gardner, Sicklerville, NJ (US)

( * ) Notice: Subject to any disclaimer, the term of this patent is extended or adjusted under 35 U.S.C. 154(b) by 63 days.

(21) Appl. No.: 13/443,237

(22) Filed: Apr. 10, 2012

(65) Prior Publication Data

US 2013/0263873 A1 Oct. 10, 2013

(51) Int. Cl.
*A45D 24/00* (2006.01)

(52) U.S. Cl.
USPC ..... 132/200; 132/212

(58) Field of Classification Search
USPC ..... 132/200, 212–214, 53–56, 333, 123; 30/30, 31, 34.05, 195
See application file for complete search history.

(56) References Cited

U.S. PATENT DOCUMENTS

| | | | | |
|---|---|---|---|---|
| 296,492 | A | 4/1884 | Wheeler | |
| 334,724 | A | 1/1886 | Ruekstuhl | |
| 764,064 | A | 7/1904 | Minter | |
| 825,756 | A | 7/1906 | Peters | |
| 934,585 | A | 11/1909 | Trafford | |
| 2,693,641 | A | 11/1954 | Omoto | |
| 2,700,820 | A | 2/1955 | Garduno | |
| 2,865,380 | A * | 12/1958 | Mitchell | 132/201 |
| 3,100,935 | A | 8/1963 | Leafe | |
| D199,564 | S | 11/1964 | Koss | |
| D207,832 | S | 5/1967 | Bridges | |
| 3,372,477 | A * | 3/1968 | Hoppe | 606/138 |
| 3,439,420 | A * | 4/1969 | Erickson | 30/294 |
| D229,877 | S | 1/1974 | Ament | |
| 3,840,031 | A | 10/1974 | Walker | |
| 4,509,538 | A | 4/1985 | Ramik | |
| D307,820 | S | 5/1990 | Ullom et al. | |
| 5,010,648 | A * | 4/1991 | Takigawa | 30/195 |
| 5,720,105 | A | 2/1998 | Gates | |
| 5,782,068 | A | 7/1998 | Flint | |
| 6,095,154 | A | 8/2000 | Robinson | |
| 6,240,645 | B1 * | 6/2001 | Ozeki | 30/294 |
| 6,394,037 | B1 | 5/2002 | Smith | |
| 7,284,557 | B1 | 10/2007 | Williams | |
| D580,052 | S | 11/2008 | White | |
| 7,958,583 | B1 | 6/2011 | Heffner | |
| 2006/0096610 | A1 * | 5/2006 | Bradford et al. | 132/212 |
| 2006/0266379 | A1 * | 11/2006 | Shelton | 132/333 |
| 2007/0056602 | A1 * | 3/2007 | Love-Johnson | 132/212 |
| 2007/0125398 | A1 * | 6/2007 | Johnson | 132/200 |

* cited by examiner

*Primary Examiner* — Todd Manahan
*Assistant Examiner* — Brianne Kalach
(74) *Attorney, Agent, or Firm* — Jason F. Cotter; Archer & Greiner, P.C.

(57) ABSTRACT

A hair weave removal tool comprising a shaft having first and second ends; and at least one peripheral, each peripheral having a base, including the capability of attaching the peripheral to the shaft, wherein at least one peripheral comprises a fork and razor peripheral, comprising: a prong extending from the base generally opposite the point of attachment to the base, at least two arms extending from the prong, and a blade extending between the arms.

2 Claims, 6 Drawing Sheets

COMBINATION WEAVE REMOVAL TOOL APPARATUS AND METHOD FOR USE

FIELD OF THE INVENTION

The present invention relates to a tool for removing sewn-in hair weaves and method of using the same.

BACKGROUND OF THE INVENTION

Hair extensions are commonly used by individuals seeking to supplement the length or volume of their natural hair through the use of hair extensions. Hair extensions can be affixed to an individual's natural hair by any number of means, including the use of a sewing technique.

Hair weaves are often affixed to an individual by a sewing technique. The sewing technique begins with braiding an individual's hair into cornrows. Artificial hair is sold in segments, each called a "track," designed to be affixed to a segment of a cornrow. Free flowing individual hair strands are located at one end of an artificial hair segment. The individual hairs on a track are bound or glued to a thin fabric at the end opposite to the free flowing hair. This fabric is often referred to as a "weft." Optionally, a net can be used to cover cornrows when tracks are intended to be placed over all or substantially all of an individual's natural hair. Alternatively, the cornrows can be sewed down when tracks are intended to be placed over all or substantially all of an individual's natural hair. Each weft is sewn onto the braids with a needle and thread. The needle and thread commonly penetrate the weft and the cornrow such that the track is secured to an individual's hair, giving the appearance of natural hair.

The sewn weft is secured at each end by a tight knot. This prevents the threads from becoming untangled during use. The point on either side of the weft with the tight knot is referred to as an anchor point.

Typically, a track can remain secured to an individual's hair in this manner for 4 to 6 weeks with proper maintenance. Removing the tracks at the end of their operational life, or when otherwise desired by an individual, can be difficult using tools available in the art. Commonly, stylists will utilize small pairs of scissors to lift a track from the scalp and cut each of the threads securing the track to the cornrow. This is a tedious process, involving fine motor skills and complicated by a stylist's difficulty discerning an individual's hair from similarly colored thread. Consequently, the use of scissors can unintentionally cut an individual's natural hair, along with the thread. Once an individual's braids are removed, the small cuts in the individual's hair caused by this process often results in an unaesthetic and unintended result. A need, therefore, exists in the art to develop a tool that can remove a track while minimizing the amount of natural hair cut in the process. A further need exists in the art to develop a single tool that can also work to facilitate the untangling of a cornrow braid after tracks are removed.

Presently, multiple tools are used for these purposes in the current state of the art, thereby reducing efficiency and increasing the amount of time required to remove hair extensions. Accordingly, the cost of the procedure would be reduced if a single tool could be developed to address each of these steps. Furthermore, existing tools can be improved by developing implements that minimize the amount of natural hair lost when the hair extensions are removed.

SUMMARY OF THE INVENTION

According to the present invention, the foregoing and other objects and advantages are obtained by a hair weave removal tool comprising a shaft with a first and second ends and at least one peripheral, each peripheral having a base that can be attached to the shaft. At least one of the peripherals comprises a fork and razor peripheral further comprising a prong extending from the base generally opposite the point of attachment of the peripheral to the base, at least two arms extending from the prong and a blade extending between the arms.

In another aspect of the invention, the arms are substantially parallel to one another. In another aspect of the invention, the distance between the arms substantially corresponds to the diameter of a hair braid anchor knot. In another aspect of the invention, another peripheral comprises a hook and razor peripheral further comprising a hook extending from the base generally opposite the point of attachment between the base and the shaft where the hook has a blade provided on the inner surface of the hook. In another aspect of the invention, another peripheral comprises a scalp scratching peripheral, further comprising an elongated pole with a tapered end, whereby the elongated poll extends from the base generally opposite the point of attachment between the base and the shaft. In another aspect of the invention, at least one removable cap can be placed over at least one of the peripherals.

In another aspect of the invention, an improved method for removing a sewn-in hair weave comprises the steps of providing a sewn in hair weave with the artificial hair elevated in a position to observe the point at which a weft is sewn into a hair braid; providing a tool with a fork peripheral with at least two substantially parallel arms extending substantially perpendicular from a base removably attached to a first end of the tool's shaft and a hook peripheral removably attached to a second end of the tool's shaft; sliding the arms of the fork in between a first threaded knot that anchors a weft at a first end where the base has a sharpened inner surface; pushing the tool into the first threaded knot to cut the first threaded knot with the sharpened inner surface of the base; sliding the arms of the fork in between a second threaded knot that anchors a weft at a second end; pushing the tool into the second threaded knot to cut the second threaded knot with the sharpened inner surface of the base; hooking the hook peripheral under the threaded string connecting the weft to a braid and pulling the tool away from the braid in the direction of the natural hair growth, thereby cutting the string; hooking the hook peripheral under each successive string connecting the weft to a braid and pulling the tool away from the braid in the direction of the natural hair growth, thereby cutting the remaining points of attachment between the braid and the weft; removing the weft and repeating the process for each successive weft; substituting a removable peripheral on the tool with a scalp scratching peripheral, comprising an elongated pole with a tapered point at the end opposite the tool's shaft; and sliding the scalp scratching peripheral's elongated pole into a hair braid and pulling the tool in the direction of the natural hair growth so as to release the natural hair from its braid.

In another aspect of the invention, the arms of the fork are inserted in between the braided hair and the weft before the threaded strings are cut and lifting the tool in the direction of the growth of the natural hair.

Still other advantages of the present invention will become readily apparent to those skilled in this aft from the following detailed description detailing only the preferred embodiment of the invention, simply by way of illustration of the best mode contemplated for carrying out the invention. As will be realized, the invention is capable of other and different embodiments, and its several details are capable of modifications in various respects, all without departing from the invention. Accordingly, the drawing and description are to be regarded as illustrative in nature, and not as restrictive.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
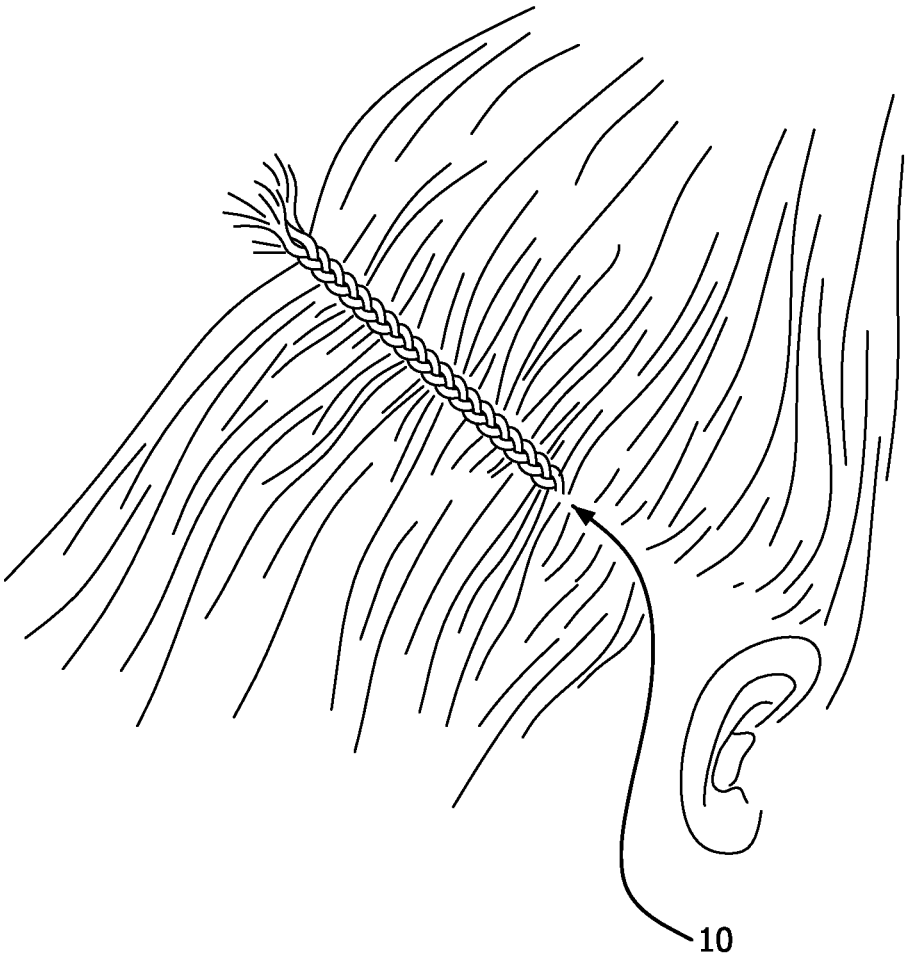
FIG. 1 shows a perspective view of an individual cornrow.

Referring to the drawings wherein like or similar references indicate like or similar elements throughout the several views, there is shown in FIG. 1 a perspective view of a cornrow, generally identified by reference numeral 10. The cornrow 10 is braided into an individual's hairline with the individual's natural hair as an initial step for attaching a track by attachment means, such as sewn threading.

Figure 2:
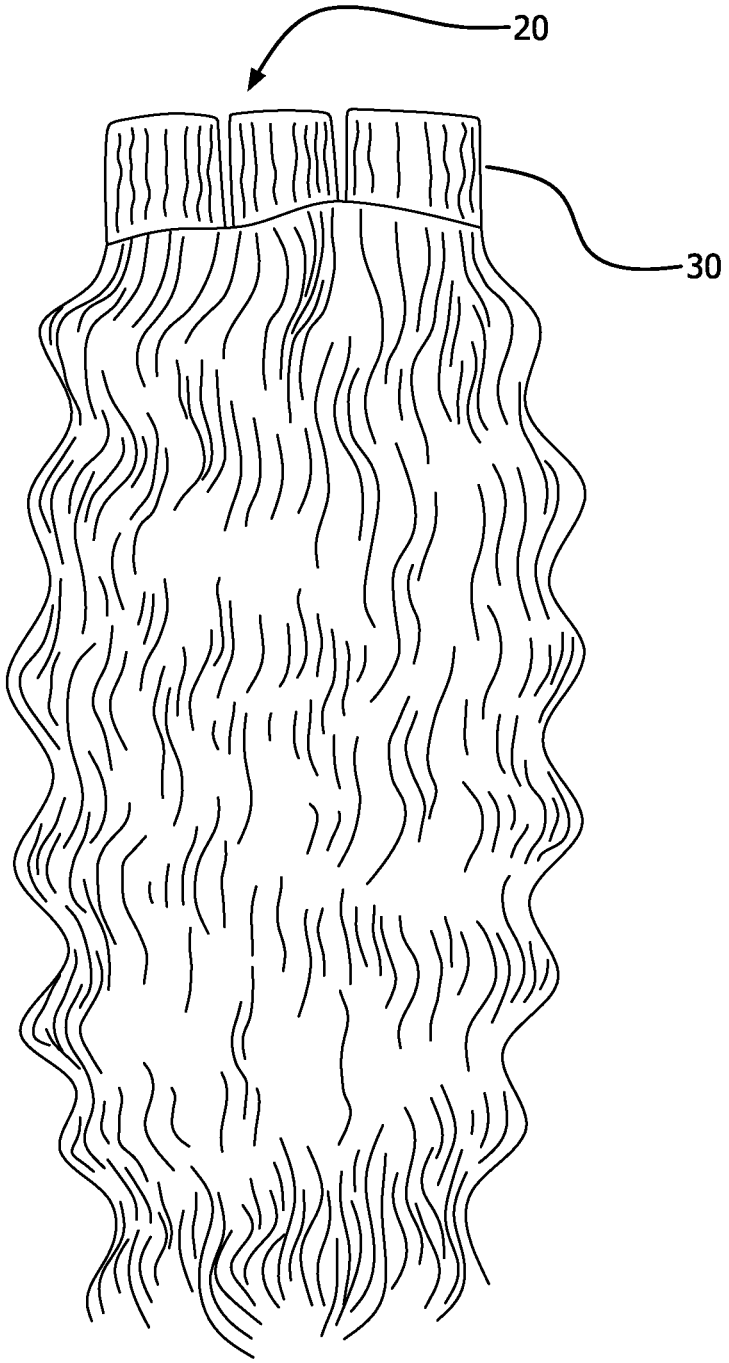
FIG. 2 shows a plan view of a series of tracks.

FIG. 2 shows a plan view of three tracks of hair extensions, where one such track is generally identified by reference numeral 20. Each track has a weft, where one such weft is generally identified by reference numeral 30.

Figure 3:
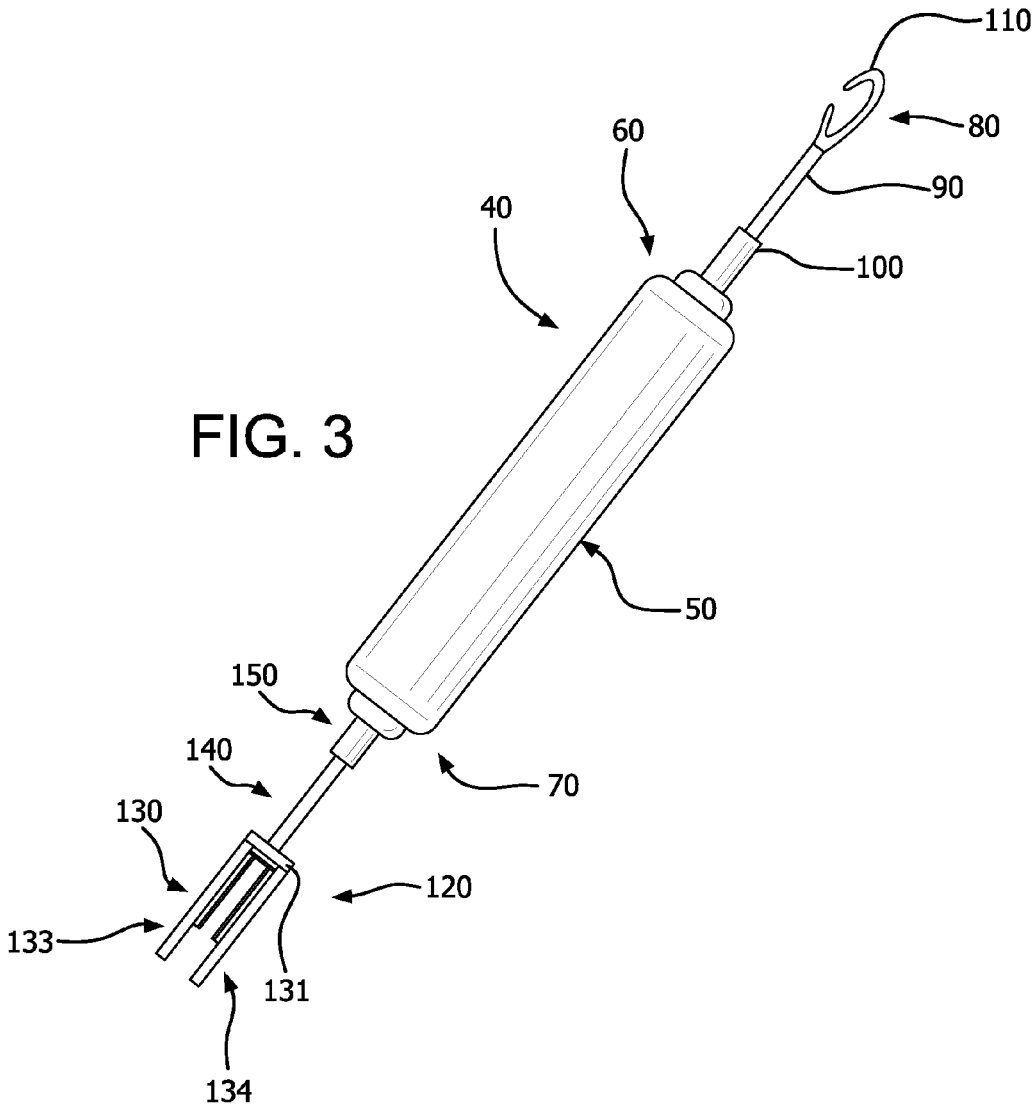
FIG. 3 shows a perspective view of a combination weave removal tool according to one embodiment of the invention.

FIG. 3 shows a perspective view of a preferred embodiment of a weave removal tool according to this invention, which is generally identified by reference numeral 40. The weave removal tool 40 contains a shaft 50 with opposing ends. The first end of the shaft 50 is generally identified by reference numeral 60. The second end of the shaft 50 is generally identified by reference numeral 70. The first end 60 and the second end 70 are each adapted to receive peripherals by removable attachment means, such as detent connections, threaded screw attachment, friction fitting or any other means commonly used in the art.

A hook and razor peripheral, generally identified by reference numeral 80 is depicted in an attached operational mode in FIG. 3. Hook and razor peripheral 80 comprises a metal hook 110 with a sharpened blade-like edge on the interior surface of hook 110. Hook 110 is attached to hook neck 90. Hook neck 90 is attached to hook base 100. Hook base 100 is connected to either the first end 60 or the second end 70 of shaft 50 by removable means, such as detent connections mated to hook base 100 and shaft 50, threaded screw attachments mated to hook base 100 and shaft 50, or friction fitting between hook base 100 and shaft 50.

Figure 7:
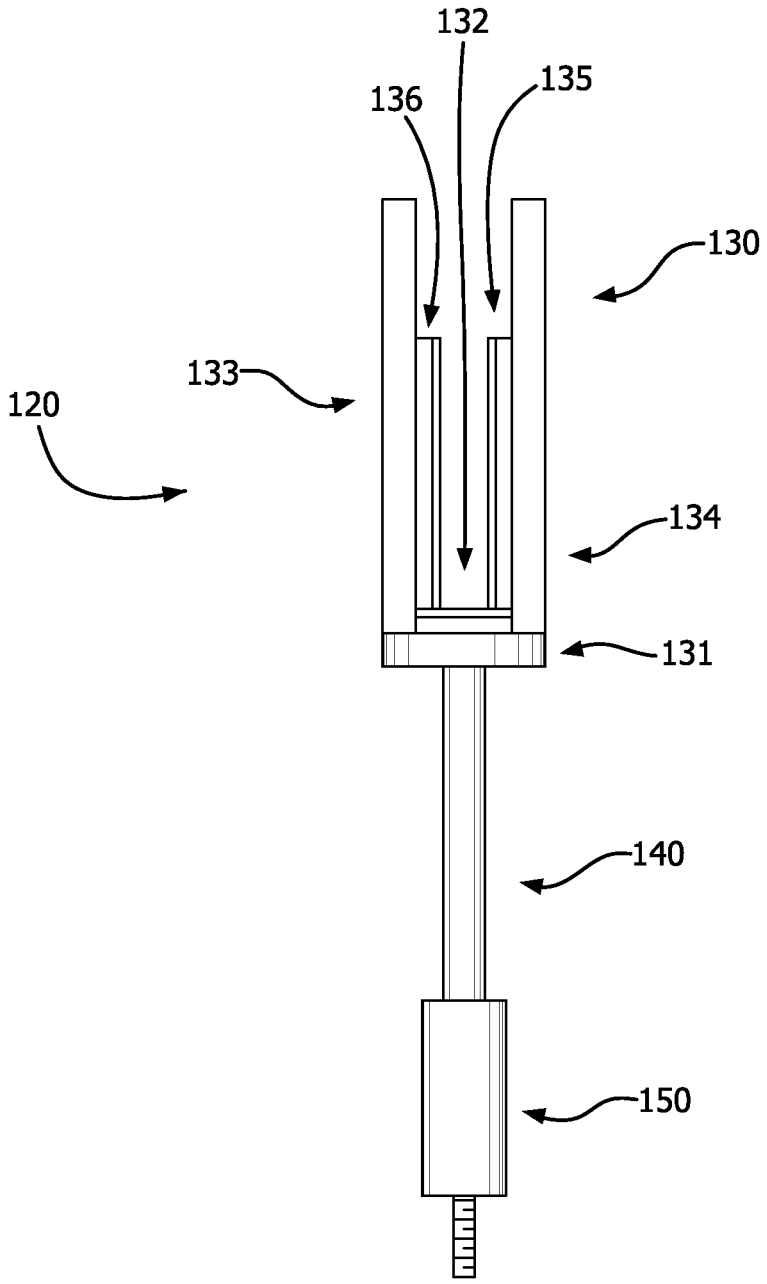
FIG. 7 shows a plan view of a fork and razor peripheral according to one embodiment of the invention.

A fork with razor peripheral, generally identified by reference numeral 120 is depicted in an attached operational mode in FIG. 3. Fork and Razor peripheral 120 is further depicted in FIG. 7 in an unattached configuration. As shown in FIG. 7, fork and razor peripheral 120 comprises a metal prong 130 with at least two substantially parallel arms 133 and 134, respectively, extending substantially perpendicularly from a support arm 131 with a sharpened blade-like edge 132 on the interior surface of the support arm 131. The opposing surfaces of arms 133 and 134 each include sharpened blade-like edges 136 and 135, respectively. In the preferred embodiment, the length of blade-like edges 136 and 135 are each less than the length of arms 133 and 135 so as to permit the arms to be inserted into a space before exposing hair or string to a cutting surface. Prong 130 is attached to prong neck 140. Prong neck 140 is attached to prong base 150. Prong base 150 is connected to either the first end 60 or the second end 70 of shaft 50 by removable means, such as detent connections mated to prong base 150 and shaft 50, threaded screw attachments mated to prong base 150 and shaft 50, or friction fitting between prong base 150 and shaft 50. In a preferred embodiment, the distance between the arms 133 and 134 on prong 130 is $1/8^{th}$ of an inch, which is only slightly wider than the diameter of a threaded knot securing the weft to the braid. In other embodiments, the distance between the arms 133 and 134 on prong 130 can be of other lengths to accommodate the diameter of an anchor knot, where such length can be determined without undue experimentation. As described further herein, the preferred embodiment's arm spacing is useful for cutting a thick knot of string without lateral movement of prong 130. Lateral movement of prong 130 diminishes a user's ability to precisely guide the prong arms and could lead to inexact application of the sharpened blade-like edge 132 on support arm 131, which could cause inadvertent natural hair cutting or damage to a weft. The arm spacing, therefore, is ideally wide enough to permit the prong arms to slide between the anchor knot, but not so wide as to permit substantial lateral movement of the tool on either side of the anchor knot.

Figure 4:
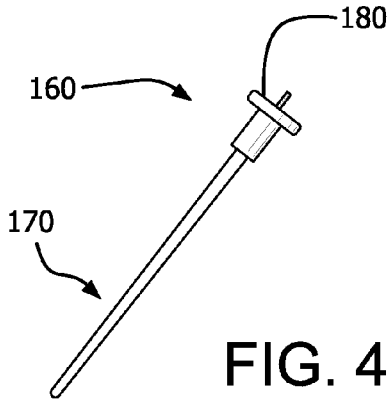
FIG. 4 shows a plan view of a hair scratcher peripheral according to one embodiment of the invention.

A scalp scratcher peripheral, generally identified by reference numeral 160 is depicted in an unattached mode in FIG. 4. The scalp scratcher peripheral 160 comprises an elongated plastic or metal pole 170. Pole 170 is tapered to a blunt point at one end and attached to pole base 180 at the other end. Pole base 180 is connected to either the first end 60 or the second end 70 of shaft 50 by removable means, such as detent connections mated to pole base 180 and shaft 50, threaded screw attachments mated to pole base 180 and shaft 50, or friction fitting between pole base 180 and shaft 50.

Figure 6:
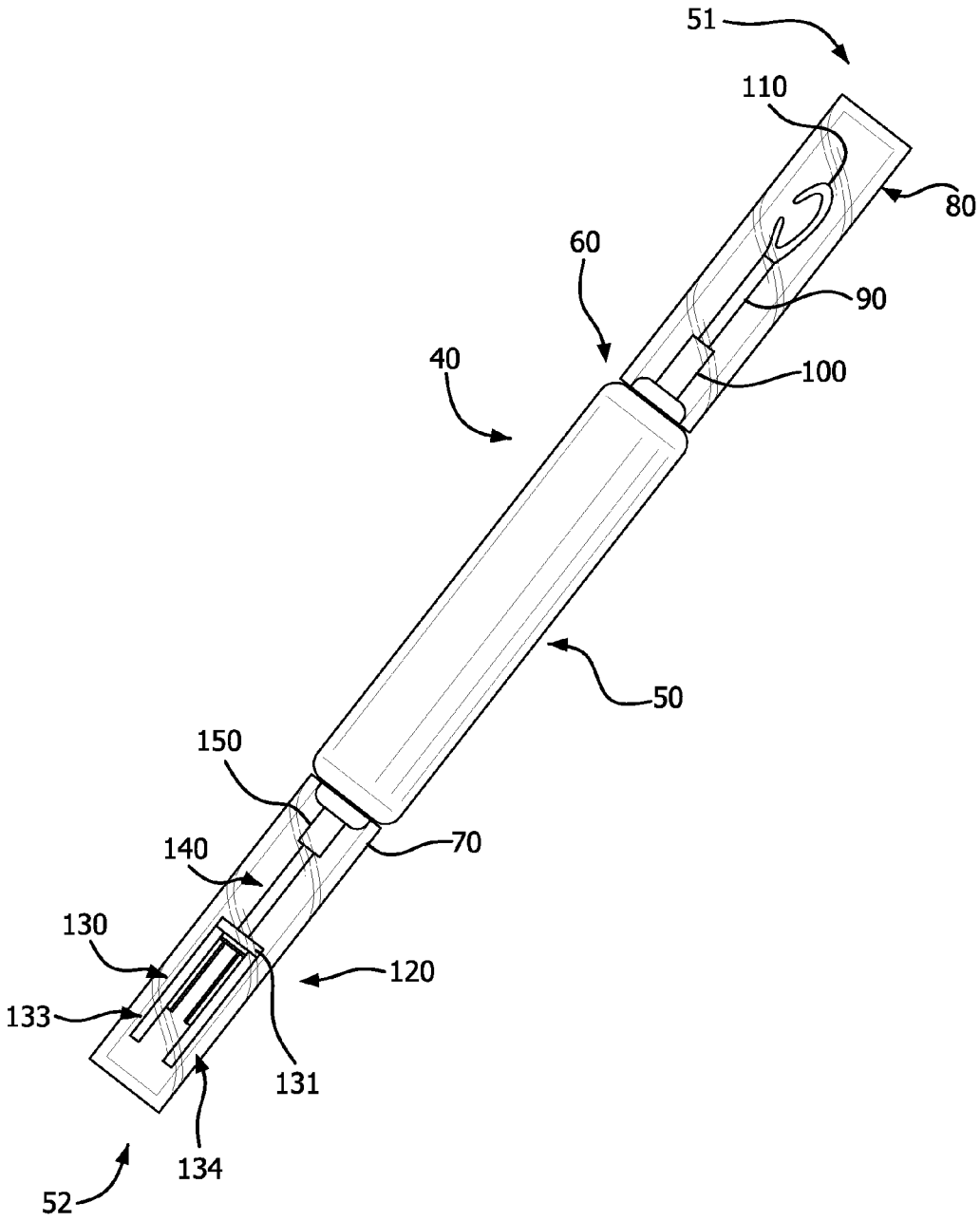
FIG. 6 shows a perspective view of a combination weave removal tool according to a second embodiment of the invention.

As depicted in FIG. 6, each of the said peripherals can be covered with a first cap 51 at a first end and a second cap 52 at a second end, each of which can be secured to the shaft 50 by detent connection or any other means known in the art to permit the said first cap 51 and second cap 52 to be secured to the shaft 50 and removed by a user. Either or both first cap 51 and second cap 52 can be removed to permit the tool's use and then, optionally, covered by first cap 51 or second cap 52 to prevent injury to the user, for example, when the tool is not in use.

In another aspect, the present invention provides a method for using weave removal tool 40. An individual's artificial hair may be pulled into an elevated ponytail or secured by any other means utilized by those having ordinary skill in the art, including the use of, for example, hair clips, in order to expose the point of connection between the sewed weft and the cornrow. Fork and razor peripheral 120 can then be connected to weave removal tool 40 in the manner herein described. Metal prong 130 is inserted such that the arms 130 and 133 of prong 130 are on either side of the anchor knot typically found at either side of the weft that are sewn into the cornrow braid located closest to the hairline. The first knot in the thread securing the weft to the cornrow is typically the tightest part of the weft, so it as advantageous to use a larger blade to cut this knot at the knot's base as opposed to using the hook with razor 110, which would be less effective in cutting the knot based on differences in the method of using each blade, as herein described. The razor sharp blade-like edge 132 on the interior surface of support arm 131 is pushed into contact with the base of the knot, thereby cutting the knot as the blade-like edge 132 is forced into the base of the knot. Alternatively, edge 136 or 135 can be forced into the base of the knot to accomplish the same cut. This process is repeated to cut the knot found at the other end of the weft. If the weft is tightly secured to the hairline, as would be anticipated if the hair extension was recently attached, metal prong 130 is inserted into the cornrow and gently lifted upwards to loosen the braided hair and facilitate the removal process in advance of the next step.

Figure 5:
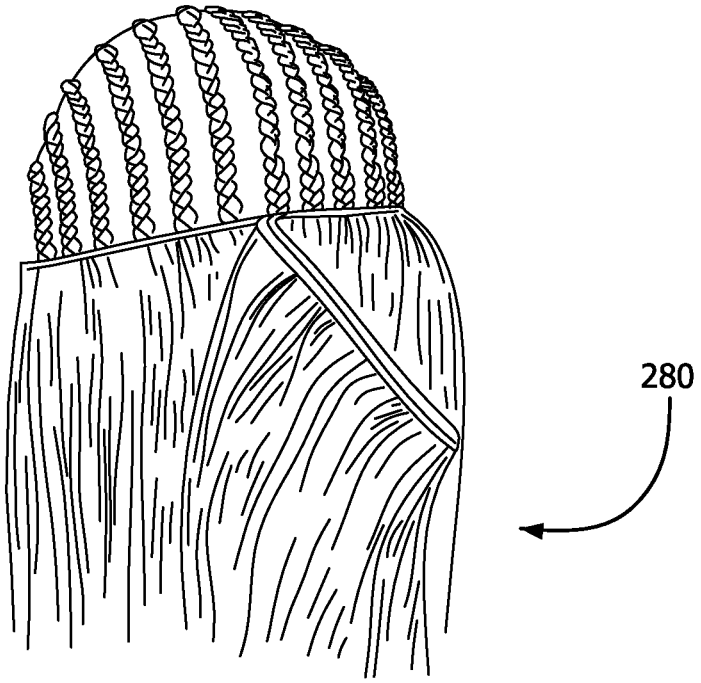
FIG. 5 shows a perspective view of hair extensions in the process of being removed from cornrows.

Hook and razor peripheral 80 can be connected to weave removal tool 40 in the manner herein described. Hook 110 is used to catch the threaded string connecting a weft 30 to a cornrow 10. As hook 110 is pulled toward the operator and away from the scalp, the string is cut. Advantageously, this technique minimizes the risk of cutting natural hair since the incision is at least substantially parallel to the growth of the hair, unlike the use of scissors that cut string without lifting the thread from the hairline. This cutting process can be repeated with hook 110 until all of the strings in the weft are cut and all of the wefts are removed. FIG. 5 depicts a weft partially removed, generally identified by reference numeral 280.

After the wefts are completely removed from a braid, the metal prong 130 can be slid in the cornrow braid at an angle perpendicular to the growth of the hair and lifted gently in the directly of the hair growth in order to remove the remaining thread from the braided hair, if desired.

The scalp scratcher peripheral 160 can be connected to weave removal tool 40 in the manner herein described. It may be necessary to remove a peripheral attached at either the first end 60 or the second end 70 of shaft 50 so that the scalp scratcher peripheral 160 can be removably connected to shaft 50 if it is not already so attached. Pole 170 is inserted at either the end of a braid at an angle perpendicular to the growth of the hair. Pole 170 is then lifted in the direction of the hair growth to untangle the braid. If desired, the hair can then be combed and washed.

All references herein to metal parts are made to exemplify a preferred embodiment, but other embodiments utilize plastic, ceramic or any other substance known in the art for accomplishing the purposes herein described. In other embodiments of the invention, one or more of the peripherals is permanently attached to shaft 50.

What is claimed is:

1. An improved method for removing a sewn in hair weave comprising the steps of:

providing a sewn in hair weave with the artificial hair elevated in a position to observe the point at which a weft is sewn into a hair braid;

providing a tool with a fork peripheral with at least two substantially parallel arms extending substantially perpendicular from a base removably attached to a first end of the said tool's shaft and a hook peripheral removably attached to a second end of the said tool's shaft;

sliding the said arms of said fork in between a first threaded knot that anchors a weft at a first end where said base and said arms each have a sharpened inner surface;

pushing the said tool into the said first threaded knot to cut the first threaded knot with the said sharpened inner surface of the said base;

sliding the said arms of said fork in between a second threaded knot that anchors a weft at a second end;

pushing the said tool into the said second threaded knot to cut the said second threaded knot with the said sharpened inner surface of the said base;

hooking the said hook peripheral under the threaded string connecting the weft to a braid and pulling said tool away from the braid in the direction of the natural hair growth, thereby cutting the string;

hooking the said hook peripheral under each successive string connecting the weft to a braid and pulling said tool away from the braid in the direction of the natural hair growth, thereby cutting the remaining points of attachment between the braid and the weft;

removing the weft and repeating the process for each successive weft;

substituting a removable peripheral on the said tool with a scalp scratching peripheral, comprising an elongated pole with a tapered point at the end opposite the said tool's shaft; and sliding the said scalp scratching peripheral's elongated pole into a hair braid and pulling the said tool in the direction of the natural hair growth so as to release the natural hair from its braid.

2. The method of claim 1 further comprising the step of inserting the said arms of said fork in between the braided hair and the weft before the threaded strings are cut and lifting the said tool in the direction of the growth of the natural hair.

* * * * *